US005456597A

United States Patent [19]

Lazar et al.

[11] Patent Number: 5,456,597

[45] Date of Patent: Oct. 10, 1995

[54] INTELLIGEN TRANSIENT ELIMINATOR FOR AN IGNITION SYSTEM

[75] Inventors: Mark M. Lazar, New Berlin; Marvin A. Lucas, Wilwaukee, both of Wis.

[73] Assignee: Johnson Service Company

[21] Appl. No.: 70,727

[22] Filed: Jun. 2, 1993

[51] Int. Cl.[6] ..... F23N 5/00; F23N 5/24

[52] U.S. Cl. ..... 431/19; 431/29; 431/31; 431/20; 236/15 C

[58] Field of Search ..... 431/6, 19, 20, 431/24, 31, 29; 236/15 C

[56] References Cited

U.S. PATENT DOCUMENTS 4,518,345 5/1985 Mueller et al. ..... 431/24
4,915,613 4/1990 Landis et al. ..... 431/6
4,955,806 9/1990 Grunden et al. ..... 431/24
5,076,780 12/1991 Erdman ..... 431/24
5,169,301 12/1992 Donnelly et al. ..... 431/20
5,186,386 2/1992 Lynch ..... 431/19

*Primary Examiner*—Carl D. Price
*Attorney, Agent, or Firm*—Foley & Lardner

[57] ABSTRACT

The present invention relates to an intelligent transient eliminator which allows a gas ignition system to prevent gas valves from being turned off by a pressure switch in response to a transient pressure wave. The transient eliminator is preferably provided in a HVAC unit or furnace which burns a fuel such as natural gas. An ignition control system employing an intelligent transient eliminator provides a secondary relay across the pressure switch. The secondary relay is controlled by a signal to an ignitor in the furnace. The secondary switch is tested before energizing the inducer blower in the system.

21 Claims, 2 Drawing Sheets

12
22
48
P1
HV
GND
HV
38
46
26B
26A
50
55
P2
1
3
4
2
30A
30B
28B
28A
42
40
51
INDUCER
PROCESSOR
MAIN IN
IGNITER
MAIN
52
53
59
ROLL-OUT SW.
PRES. SW.
58
20
72
18
44
TO TRANSFORMER
T3
T8
COOL
BYPASS
HEAT
BLOWER
HI LIM
57
78
70
77
T4 NEU.
T9 HOT
120 V.A.C.
P1
79
S5
S3
S1
S4
S2
THERMO-STAT

INTELLIGEN TRANSIENT ELIMINATOR FOR AN IGNITION SYSTEM

BACKGROUND OF THE INVENTION

The present invention relates to an HVAC unit such as a furnace or boiler which utilizes a burner or combustion chamber for burning fuel in order to provide heat. More particularly, the present invention relates to an ignition system or ignition control which lights or ignites a fuel such as natural gas, propane, or other combustible fuels.

HVAC units such as furnaces and boilers ignite and burn propane or natural gas or other fuel in order to provide heat. A furnace is generally comprised of a combustion chamber, an inducer/blower, a gas valve, an ignitor, and an ignition control system. The gas is burned in a combustion chamber or burner. Generally, an inducer/blower is coupled to the combustion chamber and provides combustion air to the combustion chamber. Combustion air is needed for efficient operation of the furnace. The combustion air generally increases the pressure within the combustion chamber.

Generally, furnaces are turned ON and OFF and otherwise monitored by a gas ignition control system or controller. The gas ignition control system is generally coupled to at least one pressure switch which is located in the combustion chamber. The pressure switch may be located before or after the combustion chamber as long as the pressure switch is in a position to sense or monitor pressure within the combustion chamber. The pressure switch is normally closed if the proper threshold pressure is reached in the combustion chamber. If the furnace is operated without proper pressure from the combustion air in the combustion chamber, a furnace malfunction may occur.

The gas ignition control system controls the operation of the inducer/blower, the gas valve, and the ignitor in order to ensure proper operation of the furnace.

The gas valves control the supply of gas to the combustion chamber. The gas valves, relays which control the gas valves, or both are electrically powered through the pressure switch. The pressure switch thus operates to automatically shut off the gas valves when the pressure switch is open. When the gas valves are shut off, the gas flame in the combustion chamber is extinguished. Alternatively, the ignition system may monitor the state of the pressure switch and shut off the gas valves when the pressure switch is open.

Gas in the furnace is ignited by the ignitor. Upon ignition, a "transient pressure wave" is produced. The "transient pressure wave" momentarily decreases the pressure in the combustion chamber and may cause the pressure switch to open although the inducer/blower is properly providing combustion air. The opening of the pressure switch in response to the "transient pressure wave" is undesirable because it prevents the proper operation of the furnace.

Heretofore, a delay circuit was used to prevent the opening of the pressure switch in response to the "transient pressure wave." When the pressure switch changes from an open state to a closed state, a delay circuit within the pressure switch closes an internal relay which shorts the pressure switch for a fixed period of time. However, the technique of using the delay circuit is undesirable because it is difficult to determine the proper length of time for the delay. Also, the delay circuit prevents the ignition control system from testing the operation of the pressure switch because the pressure switch is shorted internally. Further still, this technique is disadvantageous because the delay circuit is susceptible to failure which may extend the predetermined time. Yet another disadvantage is that the pressure switch with the internal relay and delay circuit is expensive.

SUMMARY OF THE INVENTION

The present invention provides an intelligent transient eliminator which removes the uncertainty associated with prior techniques of preventing false openings during a "transient pressure wave." Preferably, the present invention relies on a relay which is controlled by a signal from the ignition system. The present invention is configured to allow the ignition system to check the relay before the ignition of the gas.

The present invention relates to an improved ignition control system including a control circuit having an ignitor output. The ignition control system is used in an HVAC unit including a combustion chamber, a valve, an ignitor, and a pressure switch. The improvement includes a secondary switch coupled across the pressure switch. The secondary switch is controlled by a signal at the ignitor output.

The present invention further relates to an ignition control system in an HVAC unit. The ignition control system includes a pressure switch, a secondary switch, and a control circuit. The secondary switch is coupled across the pressure switch, and the secondary switch is opened and closed in response to a control signal. The control circuit provides the control signal before the HVAC unit ignites the fuel and removes the control signal after the HVAC unit ignites the fuel.

The present invention also relates to a method of turning an HVAC unit ON. The HVAC unit includes an inducer/blower, an ignitor, a pressure switch, and an ignition control system. The ignition control system includes an ignitor output and a secondary switch coupled across the pressure switch. The secondary switch is coupled across the pressure switch. The method comprises the steps of turning ON the inducer/blower, providing a signal at the ignitor output which causes the ignitor to ignite the gas in the HVAC unit, causes the secondary switch to close, and causes the secondary switch to open.

Thus, the present invention relates to an ignition control system employing an intelligent transient eliminator which provides an inexpensive technique for properly controlling a furnace. The pressure transient eliminator provides a processor controlled technique of bypassing the pressure switch.

BRIEF DESCRIPTION OF THE DRAWINGS

A preferred exemplary embodiment of an ignition control system employing an intelligent transient eliminator for an HVAC system in accordance with the present invention will hereinafter be described in conjunction with the appended drawings wherein like designations denote like elements in the various figures, and.

DETAILED DESCRIPTION OF THE INVENTION

Figure 1:
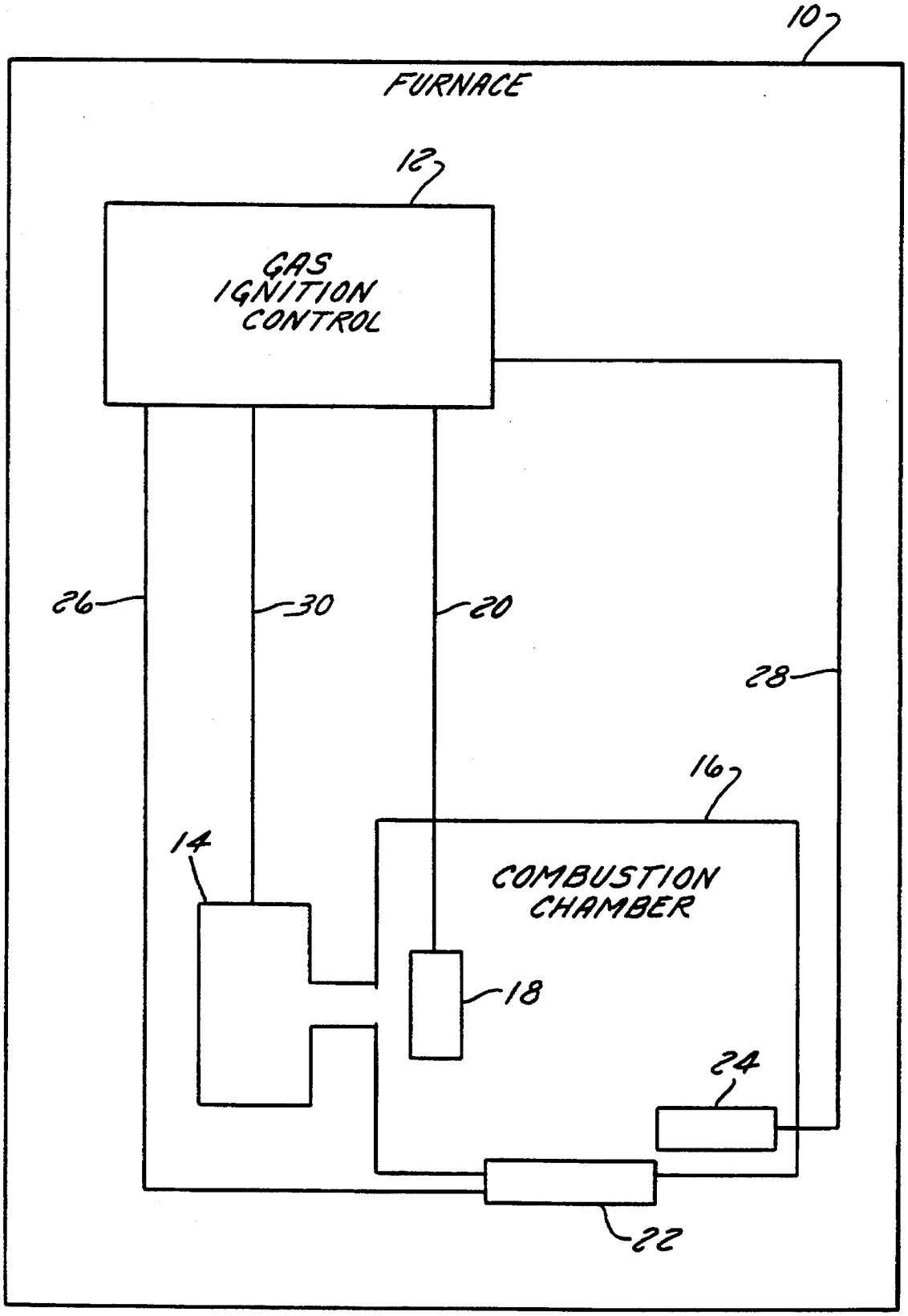
FIG. 1 is a general block diagram showing a furnace employing a gas ignition control in accordance with the preferred embodiment of the present invention.

With respect to FIG. 1, a heating unit 10 in accordance with the preferred exemplary embodiment of the present invention is illustrated in a general block diagram. The heating unit furnace 10 is a boiler, furnace, HVAC unit or other device which burns a fuel to produce heat energy which is directed to specified locations such as rooms in a building. The present invention is described by way of example in the context of a natural gas burning furnace.

The furnace 10 includes a gas ignition system or gas ignition control 12, an inducer/blower 14, a combustion chamber 16, a pressure switch 18, a solenoid operated fuel control (gas valve) 22 and an ignitor 24. The pressure switch 18 is coupled to the gas ignition control 12 via a pressure control line 20.

The gas valve 22 provides gas to the combustion chamber 16 via a natural gas source such as a gas line from the associated gas utility (not shown). The gas valve 22 is preferably at least one gas valve including a main gas valve. The gas valve 22 is controlled via gas control line 26 which couples the gas valve 22 to the gas ignition control 12. The gas valve 22 is preferably controlled by a relay or other electric control device.

The ignitor 24 is a component such as a heating coil which ignites the gas provided by the gas valve 22. The ignitor 24 is controlled by a signal from the gas ignition control 12 on an ignitor control line 28. The inducer/blower 14 is controlled via an inducer/blower line 30 by the gas ignition control 12.

In operation, the furnace 10 provides heat to a living space or other environment (not shown). When a device such as a thermostat (not shown) or other controller provides a heat request signal to the furnace 10, the gas ignition control 12 turns the furnace 10 ON by turning ON the inducer/blower 14. The inducer/blower 14 is turned ON by providing an inducer/blower signal on the inducer/blower line 30. The inducer/blower 14 provides combustion air to the combustion chamber in response to the inducer/blower signal.

After the inducer/blower is turned ON, the gas ignition control 12 opens the gas valve 22 via a gas valve control signal on the gas valve control line 26. The gas valve 22 provides gas to the combustion chamber 16 in response to the gas valve control signal. The ignitor 24 ignites the gas from the gas valve 22 in response to an ignitor control signal on the ignitor control line 28. The ignited gas provides heat which is directed to the living space.

Preferably, the gas valve 22 is powered through the pressure switch 18. The pressure switch 18 is a normally open switch which is closed when a threshold pressure from the combustion air is reached in the combustion chamber 16. Therefore, if less than the threshold pressure is present in the combustion chamber 16, the pressure switch 18 is open and power is not supplied to the gas valve 22. Thus, the gas valve 22 is closed and gas does not flow into the combustion chamber 16 when the pressure switch 18 is open.

Figure 2:
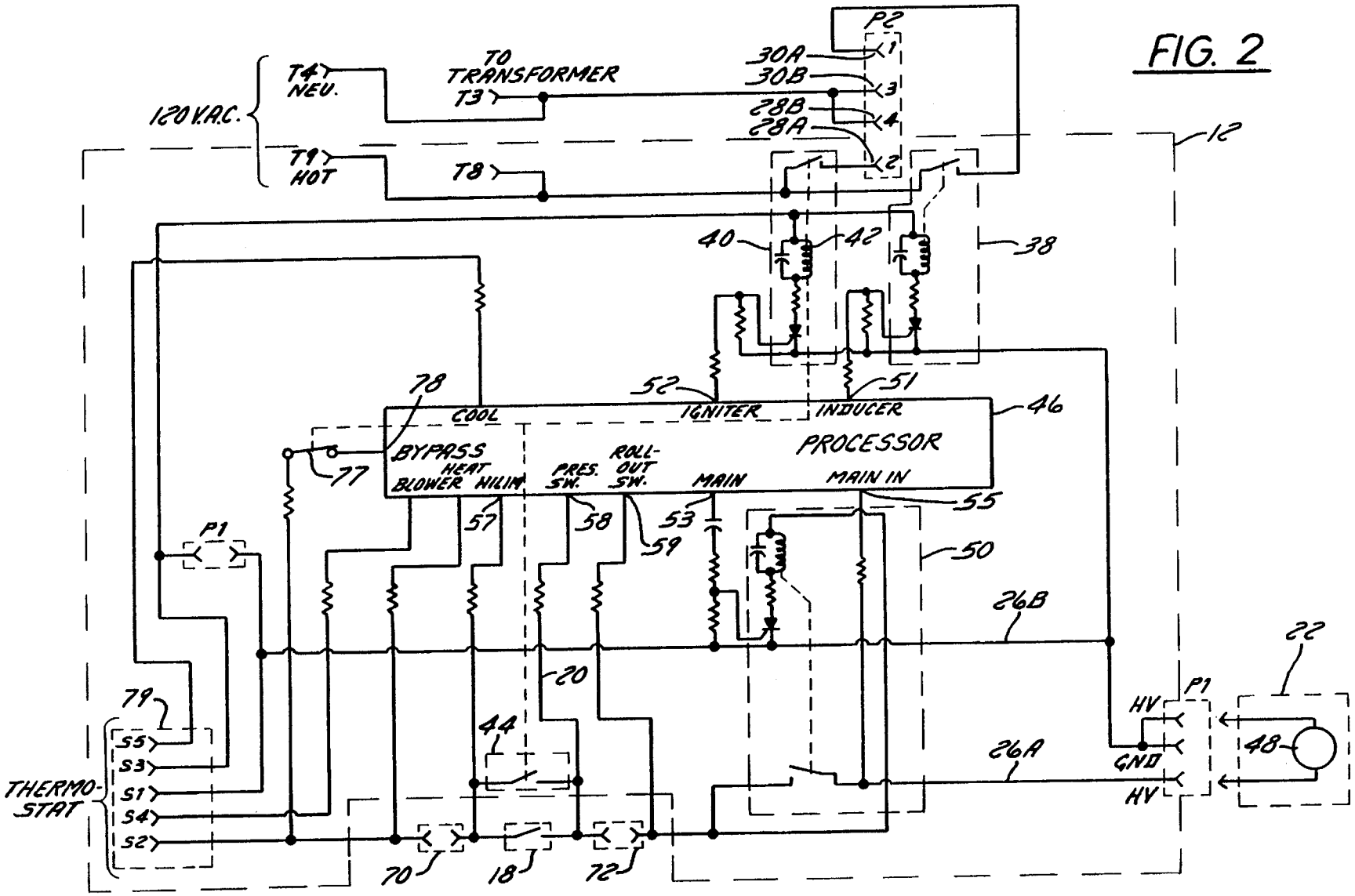
FIG. 2 is a schematic diagram of a portion of the furnace including an ignition system with an intelligent transient eliminator in accordance with preferred exemplary embodiments of the present invention.

With reference to FIG. 2, a more detailed schematic of the gas ignition control 12 is illustrated in accordance with the preferred exemplary embodiment of the present invention. The control lines 20, 26 (26A, 26B), 28 (28A, 28B), and 30 (30A, 30B) discussed with reference to FIG. 1 are exemplarily shown in FIG. 2 as preferably including resistors, relay coils or other components for interfacing with the ignition control 12.

The gas ignition control 12 is coupled to the pressure switch 18 which is preferably located in the combustion chamber 16 (FIG. 1) via the pressure switch control line 20. The inducer/blower 14 (FIG. 1) is controlled via inducer/blower control lines 30A and 30B. The ignitor 24 is controlled by ignitor control lines 28A and 28B. Preferably, inducer control lines 30A and 30B are provided inducer signals by a relay assembly 38, and the ignitor control lines 28A and 28B are provided ignitor signals by a relay assembly 40. The relay assembly 40 includes a coil 42 which controls a secondary relay 44. The secondary relay 44, which may be located in the ignition control 28 or the combustion chamber 16, is coupled across the pressure switch 18. A valve 48 in the gas valve 22 is controlled via gas valve control lines 26A and 26B. Gas valve control lines 26A and 26B are preferably provided gas signals by a relay mechanism 50.

A processor 46 in the ignition control 12 monitors and controls the operation of the furnace 10. Processor 46 is preferably a microprocessor or a microcontroller such as an MC68HC05 or HD6305. The microprocessor 46 preferably utilizes a clocked reset pin for running subroutines for controlling the furnace 10. Relay mechanisms 38, 40 and 50 are preferably controlled by outputs 51, 52 and 53, respectively, of the processor 46. A processor input 55 provides an input for monitoring the position of the valve 48. The ignition control 12 also includes inputs 79 so that a thermostat (not shown) may provide commands such as a heat request signal to the processor 46.

The processor 46 receives a high limit signal at a high limit input 57 which is coupled to a normally closed high limit switch 70. The high limit switch 70 opens when the temperature within the combustion chamber 16 is greater than a threshold limit. The processor 46 also receives a pressure switch signal at a pressure switch input 58. The pressure switch signal is provided from the normally open pressure switch 18. The processor 46 also receives a rollout signal at a rollout input 59. The rollout signal is provided by a normally closed rollout switch 72 which opens when the flame in the combustion chamber 16 is too high.

The relay mechanism 50 for the gas valve 22 is powered through the high limit switch 70, the pressure switch 18, and the rollout switch 72. In the event of a high limit condition, low pressure condition, or rollout condition, the power is not provided to the relay mechanism 50 and the gas valve 22 is automatically closed. The relay assembly 40 also includes a set of normally closed contacts 77. The normally closed contacts 77 are controlled by the coil 42. The normally closed contacts 77 provide a signal to the processor 46 at the bypass switch input 78.

Processor 46 is programmed so that control 12 operates as described below with respect to FIG. 2. When the processor 46 receives a heat request signal from the thermostat at the inputs 79, the processor 46 checks the operation of the secondary relay 44. The processor 46 reads the pressure switch input 58 to check that the pressure switch 18 is open. The pressure switch 18 is assumed to be open because the inducer/blower 14 has not yet been turned ON. The pressure switch input 58 should be a logic low because the pressure switch 18 and the secondary relay 44 are open. The processor 46 then momentarily energizes the relay coil 42 so that the secondary switch 44 is momentarily closed. The processor 46 then reads the logic high signal at the pressure switch input 58. Thus, the processor 46 may check the operation of the secondary relay 44 independent of the pressure switch 18 and the inducer/blower 14.

After the proper operation of the secondary relay 44 has been verified, the processor 46 checks for a high limit condition at the high limit input 57. If there is no high limit condition, the processor 46 turns the inducer/blower 14 ON by energizing a coil in the relay mechanism 38 by providing a logic high signal at the inducer/blower output 51. The energizing of a coil in relay mechanism 38 provides an inducer/blower signal on the inducer/blower control lines 30A and 30B.

After the inducer/blower 14 is turned ON, combustion air is provided to the combustion chamber 16 so that a threshold pressure is reached within the combustion chamber 16. The pressure switch 18 closes in response to the threshold pressure in the combustion chamber 16. The processor 46 monitors the closing of the pressure switch 18 at the pressure switch input 58. Thus, the operation of the pressure switch 18 may be independently verified after the operation of the secondary switch 44 is checked.

The processor 46 then checks for a rollout condition at the rollout switch input 59. The processor 46 then preferably turns the ignitor 24 ON, allowing the ignitor 24 to warm up. The ignitor 24 is preferably a resistive heating element. The ignitor 24 is turned ON by providing a logic high ignitor control signal at the ignitor output 52. The logic high at the ignitor output 52 energizes the coil 42 which closes the ignitor relay and provides a signal at the ignitor control lines 28A and 28B. The energized coil 42 also opens the normally closed relay 72 and closes the secondary relay 44.

When the coil 40 is energized, the secondary switch 44 bypasses the pressure switch 18. Therefore, any pressure transients, occurring during ignition, or transient pressure waves which may open the pressure switch 18 when the gas is ignited do not affect the power supplied to the gas valve 22. Preferably, the processor 46 receives the condition of the secondary switch 44 by monitoring the normally closed switch 72. The switch 72 is monitored to ensure that the contacts of the secondary relay 44 have not been welded shut. If the contacts of the secondary relay 44 are welded shut, the pressure switch 18 and the furnace 10 do not operate properly.

The processor 46 then momentarily de-energizes the coil 42 to verify the operation of the pressure switch 18. The de-energizing of the coil 42 opens the secondary switch 44 so that the operation of the pressure switch 18 may be monitored through the pressure switch input 58. If the pressure switch 18 is closed, the processor 46 re-energizes the coil 42 so that the secondary switch 44 is closed and the ignitor 24 is turned ON.

After a predetermined amount of time required for the ignitor 24 to reach the appropriate temperature, the processor 46 turns the gas valve 22 ON by providing a logic high at the main gas output 53. When a logic high is provided at the main gas output 53, the relay mechanism 50 opens the gas valve 48. The processor 46 verifies that the relay mechanism 50 has turned the gas valve 48 ON, by determining the status of the main gas input 55. When the processor determines that the flame is lit via a flame sensor mechanism (not shown), the processor 46 turns the ignitor 24 OFF.

Once a flame is sensed or the ignition control 12 otherwise determines that the gas is ignited, the ignitor 24 is turned OFF. The secondary relay 44 is opened when the coil 42 is de-energized after the ignitor is turned OFF. Alternatively, the coil 42 may be de-energized after a predetermined time. Thus, the secondary relay 44 and processor 46 provide an intelligent transient eliminator for the furnace 10.

It will be understood that while the various conductors/connectors may be shown in the drawings or described in the specification as single lines or conductors, they are not shown or discussed in any limiting way since they may comprise plural conductors/connectors as understood in the art. Further, the above description is of a preferred exemplary embodiment of the present invention; the present invention is not limited to the specific forms shown. For example, semiconductor switches, rather than relays, may be used and the processor may be programmed with various software. Further still, the various elements may be located in the ignition control or the furnace or the combustion chamber without departing from the scope of the invention as recited in the claims. These and other modifications may be made in the design and arrangement of elements discussed herein without departing from the scope of the invention as expressed in the appended claims.

We claim:

1. An ignition control system including a control circuit having an ignitor output for use in an HVAC unit, the HVAC unit including an ignitor coupled to the ignitor output, and a pressure switch coupled to the control circuit, the pressure switch being exposed to fuel, the fuel being ignited by the ignitor to form a flame in response to an ignition signal at the ignitor output, the pressure switch being configured to extinguish the flame in response to a threshold level of pressure of the fuel, the improvement comprising:

a secondary switch coupled to the pressure switch, the secondary switch having a control input coupled to the ignitor output and being controlled by the ignition signal at the ignitor output, the secondary switch disabling said pressure switch in response to the ignition signal.

2. The ignition control system of claim 1 wherein the secondary switch is a set of relay contacts.

3. The ignition control system of claim 2 wherein the ignitor output is coupled to an ignitor relay coil, and the ignitor relay coil is electromagnetically coupled to the secondary switch.

4. The ignition control system of claim 1 wherein the control circuit includes a microprocessor which provides the signal.

5. The ignition control system of claim 4 wherein the ignitor output is coupled to an electromagnetic coil.

6. The ignition control system of claim 4, wherein the pressure switch does not include a delay circuit.

7. An ignition control system in an HVAC unit for burning a fuel, the HVAC unit including a pressure switch, the pressure switch having a first pressure switch terminal and a second pressure switch terminal, the ignition control system comprising:

a secondary switch having a first secondary terminal coupled to the first pressure terminal, a second secondary terminal coupled to the second pressure terminal, and a third secondary terminal, the secondary switch being opened and closed in response to a control signal at the third secondary terminal; and a control circuit having a control output coupled to the third secondary terminal, the control circuit being coupled to the first pressure terminal of the pressure switch, the pressure switch being configured to prevent burning of the fuel when pressure of the fuel reaches a predetermined threshold, the control circuit providing the control signal at the control output before the HVAC unit ignites the fuel, wherein the secondary switch overrides the pressure switch in response to the control signal, thereby preventing transient pressure disturbances from effecting operation of the pressure switch.

8. The ignition control system of claim 7 wherein the control circuit includes a microprocessor.

9. The ignition control system of claim 7 wherein the secondary switch is a set of relay contacts.

10. The ignition control system of claim 9 wherein the secondary switch comprises a set of normally open contacts and a set of normally closed contacts, the set of normally closed contacts being coupled to the control circuit.

11. The ignition control system of claim 9 wherein the HVAC unit includes a gas valve, and the control circuit includes a gas valve control circuit powered through the pressure switch, the gas valve control circuit being coupled to the gas valve for controlling the gas valve.

12. The ignition control system of claim 11 wherein the HVAC unit includes an ignitor and the control circuit is coupled to the ignitor and provides the control signal so that the ignitor ignites the fuel in response to the control signal.

13. The ignition control system of claim 12 wherein the control signal is provided for a predetermined time after the ignitor ignites the fuel.

14. A method of actuating an HVAC unit, the HVAC unit comprising an inducer blower, an ignitor, a pressure switch, and an ignition control system, the ignition control system including an ignitor output, and a secondary switch coupled across the pressure switch, the ignitor being coupled to the ignitor output, the ignition control system being coupled to the pressure switch, the pressure switch disabling the HVAC unit in response to a threshold pressure, the method comprising steps of:

turning ON the inducer/blower;

providing an ignitor signal at the ignitor output thereby causing the ignitor to ignite gas in the HVAC unit and causing the secondary switch to close, thereby overriding the pressure switch; and opening the secondary switch, thereby allowing the pressure switch to disable the HVAC unit in response to the threshold pressure.

15. The method of claim 14 further comprising a step of verifying the operation of the secondary switch before performing the step of turning the inducer/blower on.

16. The method of claim 15 further comprising a step of verifying the operation of the pressure switch independent of the secondary switch before performing the step of turning the inducer/blower on.

17. The method of claim 16 wherein the secondary switch includes a first set of contacts and a second set of contacts, the method further comprising a step of:

checking the state of the second set of contacts.

18. The method of claim 16 wherein the operation of the pressure switch is checked by momentarily removing the ignitor signal and reading the state of the pressure switch before the gas is ignited.

19. The method of claim 18 wherein the secondary switch is a relay switch.

20. The method of claim 14 wherein the secondary switch is opened by removing the ignitor signal at the ignitor output.

21. An apparatus for controlling fuel pressure in a combustion chamber where a controller actuates at least one fuel valve and controls ignition of fuel from the fuel valve in the combustion chamber, the apparatus comprising:

valve control circuit means for actuating the fuel valve in response to a control signal from the controller;

a power input;

ignition means for lighting the fuel from the fuel valve in the combustion chamber in response to an ignition signal from the controller;

pressure switch means, coupled between the power input and the valve control means, for sensing fuel pressure of said fuel in the combustion chamber and turning the fuel valve off by removing power to the valve control circuit means when the fuel pressure reaches a predetermined threshold; and a secondary switch means coupled in parallel with said pressure switch means for disabling said pressure switch means and providing power to the valve control circuit means when said igniter means lights the fuel to compensate for transient pressure changes caused by lighting the fuel in the combustion chamber.

* * * * *